US005328111A

United States Patent [19]

Franzolini

[11] Patent Number: 5,328,111

[45] Date of Patent: Jul. 12, 1994

[54] METHOD FOR CONTROLLING THE POSITION OF THE INVERSION POINT OF THE YARN, PARTICULARLY FOR SPOOLING MACHINES, AND CORRESPONDING EQUIPMENT

[75] Inventor: Luciano Franzolini, Milan, Italy

[73] Assignee: Fadis S.p.A., Solbiate Arno, Italy

[21] Appl. No.: 950,875

[22] Filed: Sep. 24, 1992

[30] Foreign Application Priority Data

Sep. 24, 1991 [IT] Italy ..... MI91 A-002547

[51] Int. Cl.[5] ..... B65H 54/38

[52] U.S. Cl. ..... 242/18.1; 242/43.00 R

[58] Field of Search ..... 242/18.1, 43 R, 18 R, 242/18 DD

[56] References Cited

U.S. PATENT DOCUMENTS

| | | | |
|---|---|---|---|
| 3,235,191 | 2/1966 | Engleman et al. | 242/18.1 |
| 4,504,021 | 3/1985 | Schippers et al. | 242/18.1 |
| 4,504,024 | 3/1985 | Gerhartz | 242/18.1 |
| 4,667,889 | 5/1987 | Gerhartz | 242/18.1 |
| 4,676,441 | 6/1987 | Maag | 242/18.1 |
| 4,771,961 | 9/1988 | Sugioka | 242/18.1 |
| 4,779,813 | 10/1988 | Sugioka et al. | 242/18.1 |
| 4,798,347 | 1/1989 | Schippers et al. | 242/18.1 X |
| 5,056,724 | 10/1991 | Prodi et al. | 242/18.1 |

FOREIGN PATENT DOCUMENTS

| | | |
|---|---|---|
| 0118173 | 9/1984 | European Pat. Off. . |
| 0375043 | 6/1990 | European Pat. Off. . |
| 2649780 | 9/1979 | Fed. Rep. of Germany . |

*Primary Examiner*—Stanley N. Gilreath
*Attorney, Agent, or Firm*—Herbert Dubno; Yuri Kateshov

[57] ABSTRACT

Equipment for the application of the control method, particularly for spooling machines includes a detect-to the signal from an encoder capable of converting it into a binary number (N1) representing the angular position of the spool, a storing element capable of receiving at its input the binary number (N1) and of storing it for the duration of a cycle, supplying at the output a corresponding continuous signal (N2) to be sent to a digital-/analog converter capable of converting the signal (N2) to a voltage value to be sent to an adder to control the servo mechanism, a signal emitting element transmitting a signal whenever the thread guide passes through a predetermined control point of its travel, and control element capable of making available at the input of the detector a correction signal corresponding to this specific cycle, the reading of the correction signal being determined by a detector activated by the signal at the start of each cycle and by the value of the binary number (N1).

10 Claims, 4 Drawing Sheets

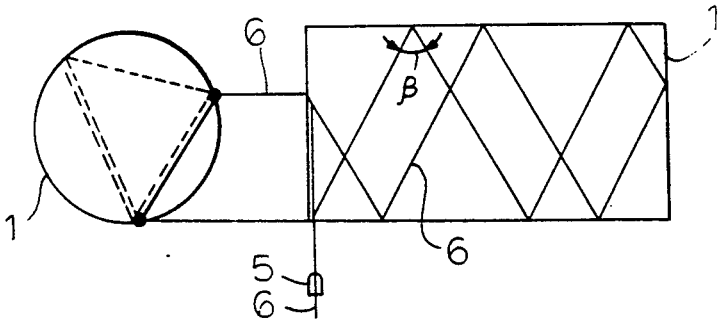
FIG.1
FIG.2
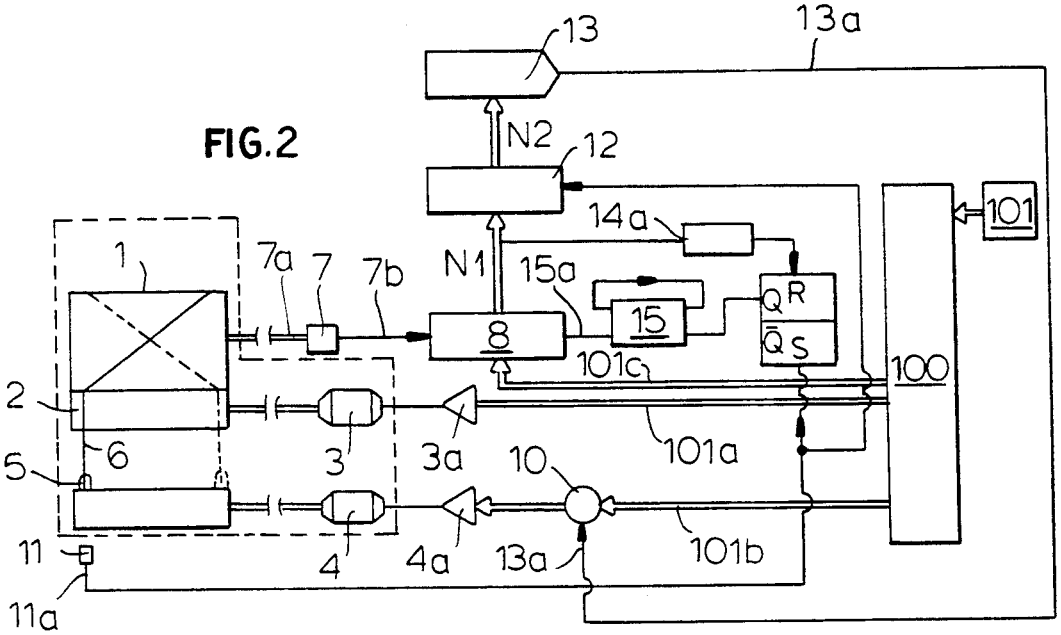
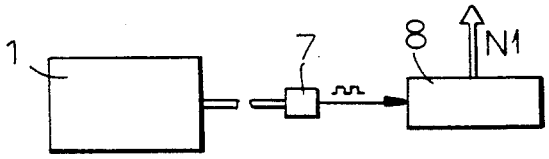
FIG.3a
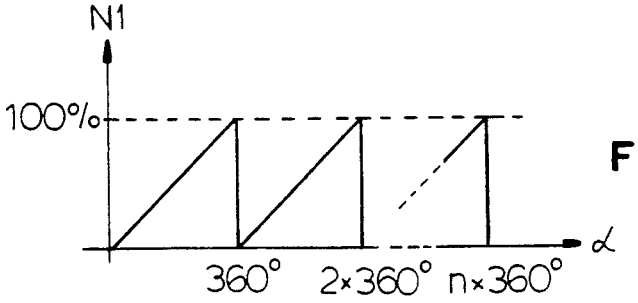
FIG.3b

METHOD FOR CONTROLLING THE POSITION OF THE INVERSION POINT OF THE YARN, PARTICULARLY FOR SPOOLING MACHINES, AND CORRESPONDING EQUIPMENT

FIELD OF THE INVENTION

The present invention relates to a method for controlling the positioning of the inversion point of a yarn during the operation of winding the yarn onto a cylindrical supporting member, and an apparatus for implementing corresponding equipment suitable of the method.

BACKGROUND OF THE INVENTION

It is known that in the textile industry every process which produces a thread makes it necessary to store the thread in such a way as to make it available in the most convenient form for the subsequent operations.

One of the most commonly used forms of the storage is provided by what is known as a spool, in other words a cylindrical member onto which the thread is wound to create a bobbin (the spool) which must have closely specified characteristics such as diameter, weight, shape, precision, and speed of unwinding. The characteristics are capable of identifying the greater or lesser suitability of a certain type of spool for the subsequent processing which may require high unwinding speed, the lowest possible unwinding tension, a uniform density or high volume.

It is also known that the above mentioned characteristics are substantially determined by the conditions of winding of the spool. In particular, two types of spool winding are known, designated "precision" and "course", which provide different types of spools. In the first case the spool is driven by the spindle and undergoes a constant number of revolutions in the time interval determined by the outward and return movement of the thread guide, thus keeping the relationship between the angular velocities of the spool and thread guide constant throughout the formation of the spool, although in these conditions the angle of laying—or crossing—of the thread must decrease with the increase of the diameter of the spool, thus causing an increase in the density of the spool which becomes excessively wide and may become unstable. In the case of course winding, on the other hand, the spool is driven indirectly by a driving cylinder which also moves the thread traversing device, in other words the grooved drum which determines the angle of laying of the thread with respect to the spool axis. In the latter when the diameter increases during spooling, given a constant thread advance speed, the relationship between the angular velocity of the spool and that of the thread guide changes, but the angle (B in FIG. 1) of laying—or crossing—of the thread remains constant, thus forming a stable and regular spool of uniform density. Under these conditions, however, since the turns ratio decreases as the spool diameter increases, the probability of superimposition of the thread, in other words, the occurrence of the undesirable phenomenon known as "mirror winding", increases, and consequently a spool is formed which, during unwinding, has characteristics which, at certain moments corresponding to the points of superimposition of the thread, differ considerably from the basic characteristics of the spool.

It is also known from the prior art that numerous attempts have been made to produce equipment capable of controlling the winding characteristics over a period of time to provide spools with the best characteristics of the two types of winding. In particular, methods and corresponding equipment for providing such control are known from the publications DE-OS 26 49 780 and U.S. Pat. No. 3,235,191. However, both publications are based on the control of the rotation speed of the winding cylinders to form windings of the rough type, but with a variation of the crossing angle within restricted limits approximating to a precision winding.

The solutions offered by the above-mentioned reference, however, have the disadvantage of basing the control procedure on the monitoring of the rotation speed, thus introducing an error into the determination of the thread position, given the variable time which relates space to speed.

Given the number of turns required to create a spool, even a small error will tend to increase over a period of time, thus increasing the probability of error in the control and reducing the probability of obtaining a spool with the desired characteristics, leading, for example, to the aforesaid phenomenon of mirror winding.

OBJECTS OF THE INVENTION

It is therefore an object of the present invention to provide a method of controlling the angular position of the inversion points of a thread wound on a cylinder or the like, while avoiding the accumulation of any positioning errors during the winding.

Still another object of the Invention is to provide control equipment capable of being applied to spooling machines in order to enable the winding characteristics of the spool to be controlled by modifying them in real time on the basis of the required unwinding characteristics, thus making it possible, among other things, to produce universal machines which are not specialized for different types of spool, and which are capable of providing the different types of winding simply by varying the control parameters of the machines.

SUMMARY OF THE INVENTION

These results are obtained with the method for controlling the position of the inversion point of the yarn, particularly for spooling machines, comprising the steps of:

determining the values of the operating parameters;

detecting, at the output of an encoder, a signal representing the angular increase of the position of the spool;

transmitting the signal to a device for converting the signal into a sequence of binary numbers which are cyclically repeated and directly represent the angular position;

transmitting the programmed value to the device;.

generate a conventional start of cycle signal;

transmitting the start of cycle signal to a temporary storage device; reading of the numerical value by the temporary storage device and maintaining the value throughout one cycle;

transmitting the continuous signal to a digital/analog converter for the creation of a voltage signal representing the positioning error;

transmitting a programmed reference signal from the central control unit to an adder;

transmitting the analog signal from the converter to the adder;

creating a compensation signal capable of controlling the servo mechanisms of a thread guide driving motor;

transmitting the start of cycle signal to the set input of a device of the flip-flop type;

detect the N1=0 condition by a zero detector;

transmitting this value N1:0 to the reset input of the flip-flop and resetting of the latter;

transmitting the output signal of the flip-flop to the input of a pulse generator; and generate a pulse to write the programmed value to the counter.

According to the invention, it is also provided that the start of cycle signal is generated for each transit of the thread guide from its conventional starting point, and that the starting point is preferably situated at one end of the thread guide driving roller.

The conversion device is also enabled to vary its content by accepting the programmed correction signal once only per cycle at the moment of the first zero setting of the binary number following the end of cycle signal, or alternatively at the moment of equality between the value of N1 and the programmed value.

The apparatus according to the invention comprises the combination: means or detecting the encoder signal capable of converting it into a binary number representing the angular position of the spool, means capable of receiving at their input the binary number and of storing it during a cycle and providing at the output a corresponding continuous signal to be sent to a digital/analog converter capable of converting the signal to a voltage value to be sent to an adder for the control of the servo mechanism and means capable of emitting a signal whenever the thread guide passes through a predetermined monitoring point for its travel and control means capable of supplying operating values programmed by the user and of making available at the input of the means a correction signal relative to this specific cycle, the reading of the correction signal being performed by corresponding means activated by the signal at the start of each cycle and by the value of the binary number.

BRIEF DESCRIPTION OF THE DRAWING

The above and other objects, features and advantages of the invention will become more readily apparent from the following description, reference being made to the accompanying highly diagrammatic drawing in which:

FIG. 1 is a geometrical representation of the form of the thread being would on the spool;

FIG. 2 is a schematic diagram of the control equipment according to the invention;

FIG. 3*a* is a detail of the system for detecting the angular position of the spool;

FIG. 3*b* is a graphic representation of the representative curve of the output of the counter as a function of the angular position of the spool;

SPECIFIC DESCRIPTION

Figure 4A:
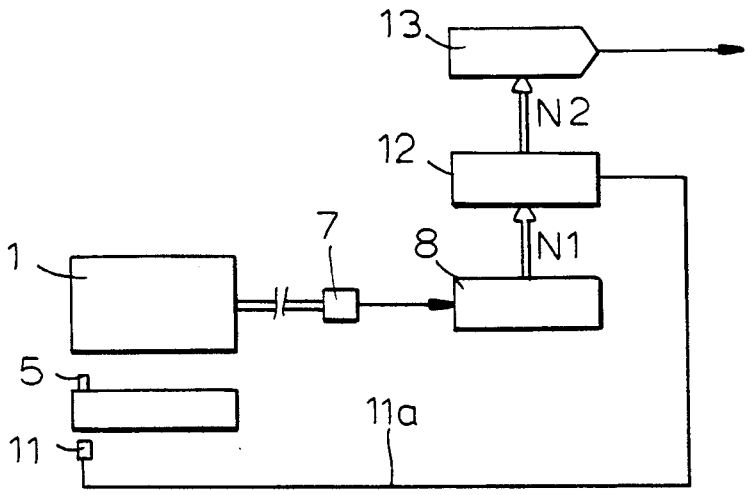
FIG. 4*a* is a simplified representation of the system for creating the signal representing the error of positioning of the winding inversion point.
Figure 4B:
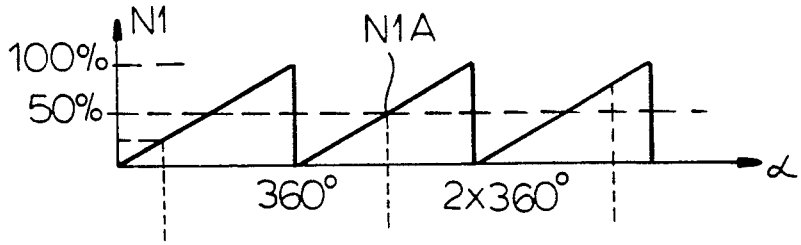
FIGS. 4*b*, 4*c*, 4*d*, 4*e* are the graphic representation of the generation of the signals of the components of the simplified system in FIG. 4*a;*
Figure 4C:
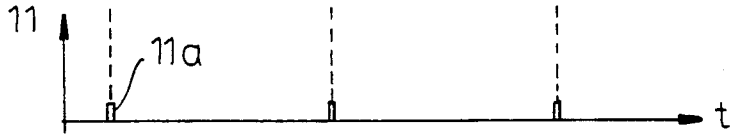
Figure 4D:
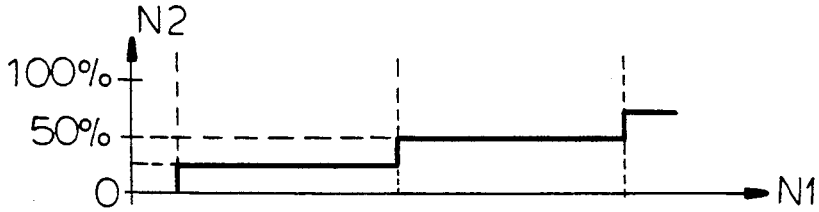
Figure 4E:
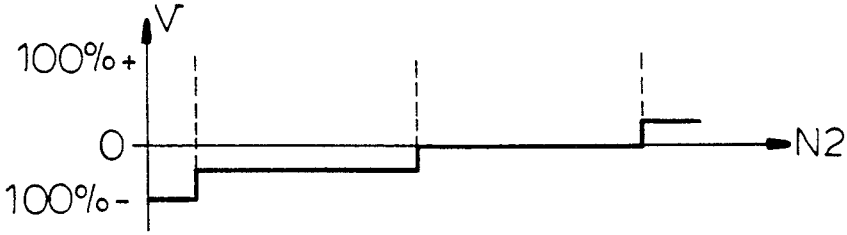

As shown in FIGS. 1 and 2, a spooling machine of a known type substantially comprises a spool i caused to rotate by a roller 2 driven by a motor 3, while a second motor 4, independent of the first, drives the thread guide 5 which supplies the thread 6 to the spool 1. To this machine there is applied a control equipment according to the invention comprising a central control unit 100 capable of receiving at its input instructions from the user 101, who sets the required operating parameters, and providing at its output a first signal 101*a* capable of supplying a servo mechanism 3*a* which causes the rotation of the motor 3 and consequently that of the spool 1 through the roller 2 at the desired speed. The central unit 100 also sends a reference signal 101*b*, proportional to the rotation speed of the motor 3 to an adder 10 whose function will be described in greater detail in the following text. The spool 1 which is caused to rotate is connected to an angular position detector 7, known as an encoder, whose shaft 7*a* is coupled to the axis of rotation of the spool in order to determine the angular position of the spool, at every moment and for each cycle of outward and return movement of the thread guide 5 to and from its initial position which is conventionally set at one end of its travel.

The encoder 7 converts the rotation of its shaft into electrical signals 7*b* which it sends to a counter 8 which supplies at its output a binary number N1 (FIG. 3*a*) which is conventionally directly representative of the angular position of the spool and consequently, as explained subsequently, of the point of inversion of the winding of the thread.

In greater detail (FIG. 3*b*), and as will be explained more fully subsequently, the curve representing this position is formed by a sawtooth curve whose zero points correspond to multiples of a circular angle ($n \times 360°$).

The information represented by the binary number N1 is made available to a temporary storage element 12, known by the English name of "latch", which however must be enabled to retain only one of the number representing the rotation and instantaneous positions of the spool, namely that corresponding to the instant at which the inversion of the travel of the thread guide 5 occurs, which determines the position of the inversion point, this instant being therefore detected by a sensor 11 located next to the cycle start point or to the point from which the thread guide departs and to which it returns at the end of its outward and return travel (the left-hand end in the example). The sensor 11 emits at the moment of the passage of the thread guide 5, a pulse 11*a* which is sent to the temporary store 12 enabling it to store the corresponding number N1 present at that moment in the counter 8, and to convert it into a continuous signal N2 which it sends to a digital/analog converter 13 which converts the logical signal (error signal) N2 into a corresponding voltage signal 13*a* sent to the adder 10 (FIGS. 2, 4*a*, 4*b*, 4*c*, 4*d*, 4*e*).

This adder adds the error signal to the reference value 101*b* received from the control unit 100, and sends a voltage compensating for any error to a corresponding servo mechanism 4*a* controlling the motor 4.

Since the error is represented by the deviation of N1 from the mean ramp value, corresponding to 180°, representing the angular position found at the instant of inversion of the laying of the thread, in other words at the moment of the pulse 11*a* emitted by the sensor 11, this deviation may be equal to zero in ideal conditions or positive or negative, depending on circumstances, as shown by way of example in FIGS. 4*b*, 4*c*, 4*d*, 3*e*.

However, a device of this type is capable of compensating for any tracking errors of the system only in the sense that it returns the point of inversion of the thread to the same angular position, corresponding to a multiple of a circular angle in the example described, and this condition is unacceptable since it corresponds to conditions of entanglement of the thread and consequently of mirror winding.

It therefore becomes necessary to introduce in each winding cycle, in other words in each outward and return movement of the thread guide 5, a correction of the number N1 representing the angular position, this correction being capable of defining a new angular position corresponding to the desired new point of inversion which differs from the preceding one, in such a way as to compel the error signal generating circuit to create a new corresponding voltage value which causes this new point to be reached.

Figure 5:
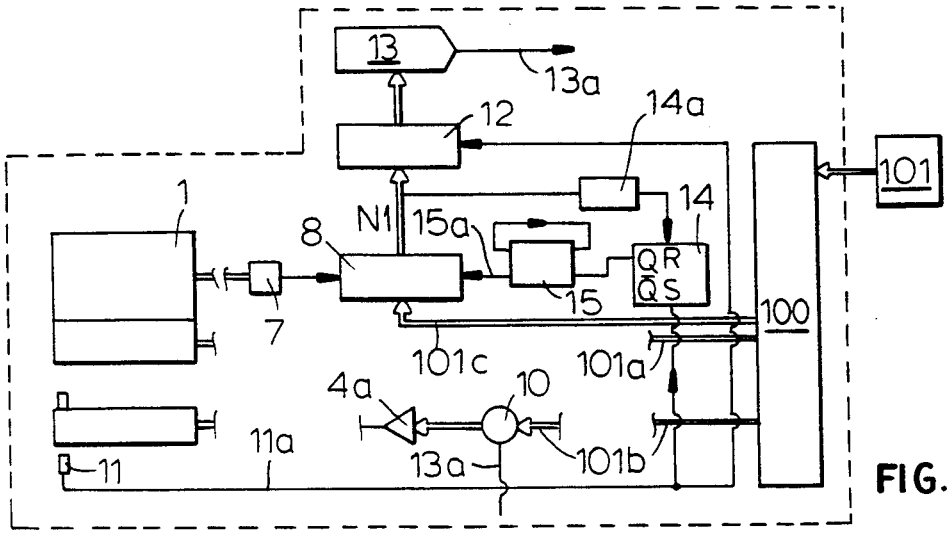
FIG. 5 is a diagram of the error signal generation system according to the present invention.
Figure 6A:
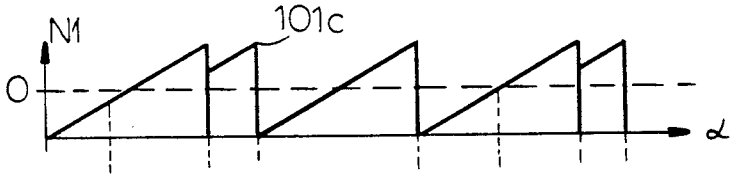
FIGS. 6*a*, 6*b*, 6*c*, 6*d*, 6*e*, 6*f* are the graphic representation of the sequence of the various signals for synchronizing the operation of the control equipment.
Figure 6B:
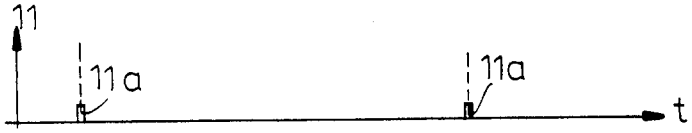
Figure 6C:
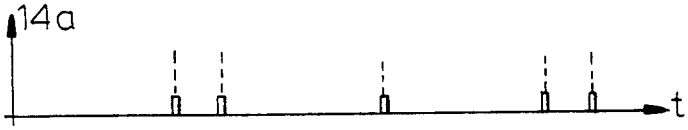
Figure 6D:
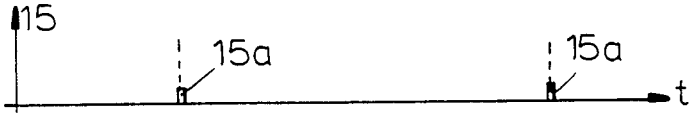
Figure 6E:
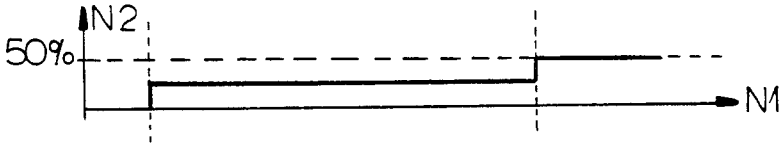
Figure 6F:
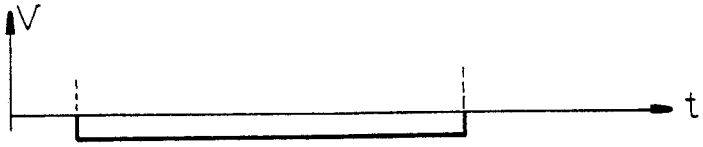

To this end, control devices are introduced as illustrated in FIG. 5, by referring to which it will be seen that the control unit 100 makes available to the counter 8 a value 101*c* in the form of a binary number, corresponding to the correction to be introduced to displace the subsequent inversion point. In order to make this correction correct, however, it is necessary that it should be made only once per cycle, for example at the instant of zero setting of the counter, and it is therefore necessary to introduce a set of enabling devices for the synchronization of the sequence represented in FIGS. 5, 6*a*, 6*b*, 6*c*, 6*d*, with reference to which the operation of the control equipment according to the present invention will be described in the following text.

During the winding of the spool 1, the encoder 7 sends corresponding signals to the counter, which periodically generates binary signals N1 according to the sawtooth curve (FIG. 6*a*), sending them to the Input of the latch 12 and to the input of a zero (N1=0) detector 14*a* whose output temporarily sets to zero the reset input R of a logical component known as a flip-flop 14, whose logic output Q constitutes the enabling signal for a monostable pulse generator circuit 15 which is connected to the counter 8.

Whenever the thread guide 5 passes through the starting position, or at the start of each cycle, thus determining the instant and consequently the position of the inversion point, the sensor 11 emits the enabling pulse 11*a* (FIG. 6*b*) which is simultaneously sent to the set input S of the flip-flop 14 and to the latch 12 which stores the value of N1 corresponding to the angular position of the spool 1 at the moment of inversion of the winding, this continuous value being sent to "the converter 13 to generate the analog error signal to be sent to the adder 10.

Simultaneously, the device detects the start of cycle signal, setting the flip-flop 14 which, when the counter 8 passes through its first zero (N1=0) following the start of cycle signal and thus also sets the input R of the flip-flop 14 to zero, enables the pulse generator 15 to emit a counter enabling pulse 15*a*, the counter 8 registering the value 101*c* corresponding to the new angular position to be reached at the end of the current cycle specified by the control unit 100 on the basis of the operating parameters specified, in turn, by the operator.

Figure 7:
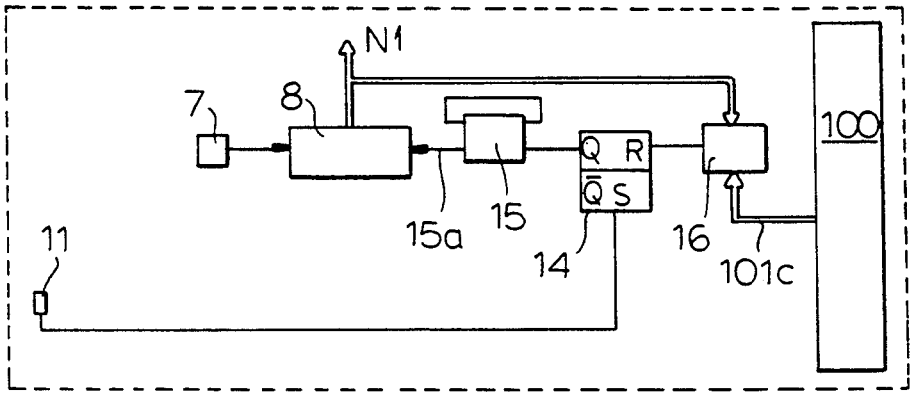
FIG. 7 is a simplified diagram of a variant embodiment of the counter zero setting device.

The whole correction sequence is then repeated with each cycle, thus obtaining for each cycle a new value of the inversion point which is unaffected by any errors introduced into the preceding cycle, and at the same time preventing any preceding positioning errors from accumulating over a period of time. FIG. 7 illustrates a variant embodiment of the circuit for introducing the correction into the counter, which in this case requires the addition of a comparator 16 which receives at its input the value 101*c* set by the central unit 100 and the current value of N. When the two values are equal (N1=101*c*), the flip-flop 14 is reset, enabling the pulse generator 15 to emit a pulse 15*a* which sets to zero the content of the counter for the duration of the pulse.

Figure 7A:
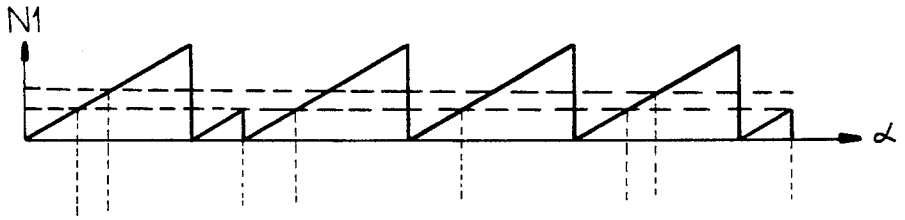
FIGS. 7*a*, 7*b*, and 7*c*, are the graphic representation of the generation of the signals of the components of the simplified system in FIG. 7.
Figure 7B:
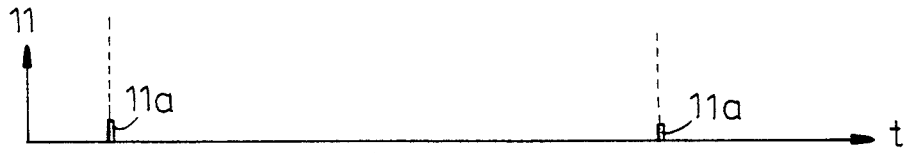
Figure 7C:
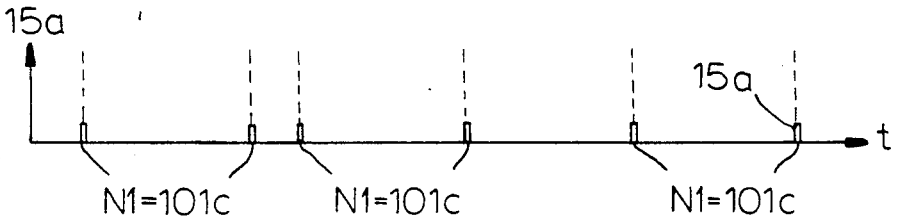

As seen in FIGS. 7*a*, 7*b*, 7*c*, in this case the counter is set to zero when there is parity between N1 and 101*c*.

It is therefore evident that the control equipment according to the invention is capable of generating a curve of binary numerical values corresponding to relative angular positions of the spool, these values, together with the spool rotation speed and the predetermined angle of inversion, determining the desired final characteristics of the spool, and that on the basis of the said numerical values it is possible to create a corresponding curve of voltage values representing the error of positioning of the inversion point, whose comparison with the programmed reference values determines the correction of the rotation speed of the thread guide supply motor, correcting any deviations from the programmed configuration.

Since it is also possible to know at any instant the angular position of the spool and consequently of the various thread inversion points, it is possible to control the correctness of these without accumulation of any system errors which remain unchanged even after a large number of turns.

Many modifications may be made without thereby departing from the scope of the invention in its general characteristics.

I claim:

1. A method of controlling an inversion point of yarn in a spooling machine, the method comprising the steps of:

(a) generating in a control unit a set of operating parameters including a spool speed, a yarn-guide speed and a binary number representing a correction of the inversion point;

(b) transmitting a first signal to a first servo mechanism from the control unit representing said spool speed, thereby actuating a spool motor rotating a spool at a selected speed;

(c) transmitting a control signal to a second servo mechanism, thereby actuating a guide driving motor of a thread guide, the thread guide traveling in a cycle defined by back and forth motion to and from an initial position of the thread guide, each of subsequent cycles having, at an instant of inversion of the travel of the thread guide, a respective inversion point of the guide which defines a start of a respective subsequent cycle;

(d) detecting a start of cycle signal at a start point of a current cycle and transmitting the start of cycle signal as an enabling signal to a temporary storage device;

(e) detecting angular positions of said spool and producing a second signal representing an angular position of said spool throughout each cycle at an output of an encoder;

(f) transmitting the second signal to a counter generating a sequence of a binary numbers (N1) directly representing the angular position of the spool;

(g) storing in said storage device a value of the binary number in said counter representing the angular position of the spool at the point of transmission of said start of cycle signal to said storage device;

(h) generating a continuous signal corresponding to the value stored in said storage device in a digital/analog converter emitting a corresponding voltage signal representing a positioning error during each cycle;

(i) sending the voltage signal to an adder for combining the voltage signal with a reference signal from the control unit representing said yarn guide speed to generate a control signal for correcting the second servo mechanism and the guide driving motor;

(j) applying said start of cycle signal to a set input of a flip flop device, thereby setting the flip-flop device; and (k) setting a reset input of the flip-flop device at a selected angular position of the spool and transmitting from said flip-flop device at least in part through a pulse generator to said counter an increment determined by said binary number representing said correction of the inversion point, whereby said inversion point is shifted from cycle to cycle.

2. The method defined in claim 1 wherein the counter is enabled by said pulse generator to accept said control signal once per cycle.

3. The method defined in claim 2 wherein step (k) comprises the step of detecting a N1=0 condition of the continuous signal by a zero detector generating a respective output signal resetting the flip-flop device.

4. The method defined in claim 1 wherein step (k) comprises the step of comparing said binary number with the value of the binary number from said control unit representing correction of and resetting said flip flop in response to the comparison.

5. The method defined in claim 1 wherein the start of cycle signal is generated upon transmitting of the thread guide from a given point thereof, said given point being a starting point located at one end of a driving roller of the thread guide.

6. An apparatus for controlling an inversion point of yarn in a spooling machine, the apparatus comprising:

a control unit transmitting a set of operating parameters including a spool speed, a yarn-guide speed and a binary number representing a correction of the inversion point;

a shaft formed with a spool;

a spool motor connected with said shaft for rotating a spool at a selected speed;

a first servo mechanism receiving a first signal representing said spool speed from the control unit and controlling said spool motor;

a second servo mechanism receiving a control signal from said control unit;

a thread guide for supplying a thread to said spool;

a guide driving motor operatively connected with said second servo mechanism for actuating the thread guide, said thread guide traveling in a cycle defined by back and forth motion to and from an initial position of the thread guide, each of subsequent cycles having, at an instant of inversion of the travel of the thread guide, a start point of a respective subsequent cycle;

control means for detecting a start of cycle signal at a start point of a current cycle and for transmitting the start of cycle signal as an enabling signal;

storage means responsive to said enabling signal;

sensing means connected with said spool for producing a second signal representing an angular position of said spool throughout each cycle at an output of said sensing means;

counter means connected to said sensing means and responsive to the second signal to generate a count of binary numbers (N1) directly representing the angular position of the spool, said storage means storing a value of the binary number in said counter means representing the angular position of the spool at the point of transmission of said start of cycle signal as said enabling signal to said storage means;

a digital/analog converter for generating a continuous signal corresponding to the value stored in said storage means, said continuous signal being a voltage signal representing a positioning error during each cycle;

adder means receiving said voltage signal for combining the voltage signal with a reference signal from said control unit representing said yarn guide speed to generate said control signal for correcting the second servo mechanism and the guide driving motor;

a flip-flop device formed with set and reset inputs, said set input receiving said start of cycle signal from said control means for setting the flip-flop device, said reset input of the flip-flop device being set at a selected angular position of said spool; and generating means for transmitting at least in part from said flip-flop device to said counter means in increment determined by said binary number representing said correction of the inversion point, whereby said inversion point is shifted form cycle to cycle.

7. The apparatus defined in claim 6 wherein the counter means includes a counter receiving said binary number representing said correction of the inversion point directly from said control unit.

8. The apparatus defined in claim 6 wherein the storage means includes a latch or register.

9. The apparatus defined in claim 6, further comprising a zero detector for setting said reset input of said flip-flop device upon detection of a value N1=0.

10. The apparatus defined in claim 6, further comprising means including a device for comparing said binary number representing the correction of the inversion point with the value of the binary number in said counter means and generating a pulse from the comparison.

* * * * *